United States Patent [19]

Dawes

[11] Patent Number: 4,481,079

[45] **Date of Patent: * Nov. 6, 1984**

[54] SPIRAL FABRIC PAPERMAKERS FELT FORMED FROM NON-CIRCULAR CROSS SECTION YARNS

[75] Inventor: Donald Dawes, Waycross, Ga.

[73] Assignee: Scapa Inc., Waycross, Ga.

[ * ] Notice: The portion of the term of this patent subsequent to Jul. 26, 2000 has been disclaimed.

[21] Appl. No.: 423,468

[22] Filed: Sep. 24, 1982

Related U.S. Application Data

[63] Continuation-in-part of Ser. No. 273,031, Jun. 12, 1981, Pat. No. 4,395,308.

[51] Int. Cl.[3] ..... D21F 1/10; D04H 3/02

[52] U.S. Cl. ..... 162/348; 162/DIG. 1; 28/141; 139/383 A; 428/222; 428/224; 428/397

[58] Field of Search ..... 162/232, 290, 348, 359, 162/DIG. 1; 34/116, 123; 139/383 A, 383 AA, 425 A; 245/6; 428/222, 224, 293, 294, 365, 371, 397; 28/141, 142

[56] References Cited

U.S. PATENT DOCUMENTS

| | | | |
|---|---|---|---|
| 1,263,564 | 4/1918 | Kida | 474/239 |
| 1,794,624 | 3/1931 | Kastner | 139/425 A |
| 2,199,529 | 5/1940 | Shackelford | 474/239 X |
| 3,436,041 | 1/1969 | Haller | 28/141 X |
| 3,562,079 | 2/1971 | Steel | 428/224 X |
| 3,851,681 | 12/1974 | Egan | 139/425 A X |
| 4,076,627 | 2/1978 | Friedrichs | 139/425 A |
| 4,142,557 | 3/1979 | Kositzke | 139/425 A |
| 4,345,730 | 8/1982 | Leuvelink | 428/98 X |
| 4,346,138 | 8/1982 | Lefferts | 428/222 |
| 4,395,308 | 7/1983 | Dawes | 162/232 |

FOREIGN PATENT DOCUMENTS

| | | | |
|---|---|---|---|
| 0017722 | 10/1980 | European Pat. Off. | 162/348 |

*Primary Examiner*—William Smith

*Attorney, Agent, or Firm*—Fleit, Jacobson, Cohn & Price

[57] ABSTRACT

A dryer felt comprising a plurality of spiral coils disposed in a common plane and arranged in a side-by-side relationship with adjacent coils being intermeshed and joined together in a hinged relationship by a hinge yarn. During manufacture, the fabric is subjected to a heat treatment under controlled tension to cause the spiral coils, which are normally circular, or elliptical in cross-section to assume the shape of the hinge yarns which are typically of rectangular, elliptical, D-shape, dog bone or two or more circular cross section yarns with the long side of the stuffer yarn lying in the plane of the fabric. In this way, the air voids within the fabric are substantially filled by the hinge yarns to reduce permeability, while the flattened spiral coils provide smooth paper-receiving and machine roll contacting surfaces on the resultant dryer felt. The coils are formed from yarns having a non-circular cross section and with their respective longer axes oriented in a direction generally parallel to the upper and lower surfaces of the felt.

14 Claims, 8 Drawing Figures

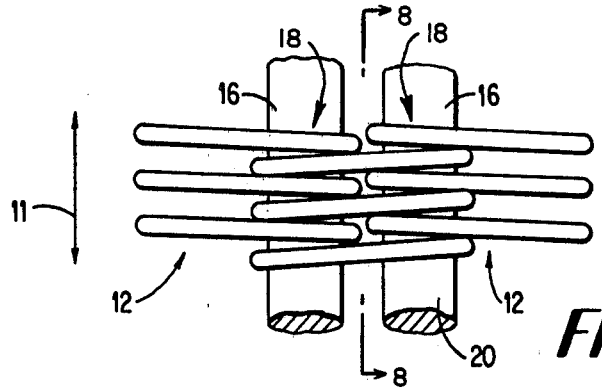
FIG. 1
FIG. 2
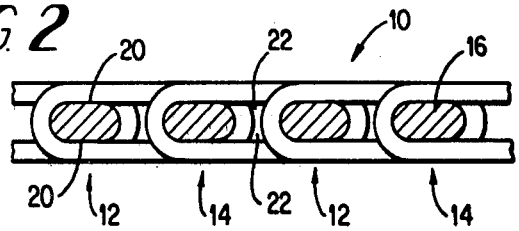
FIG. 3
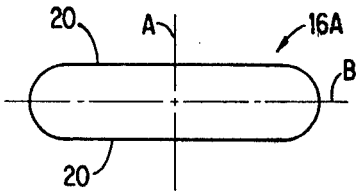
FIG. 4
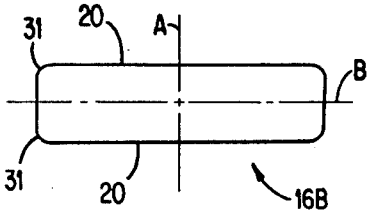
FIG. 5
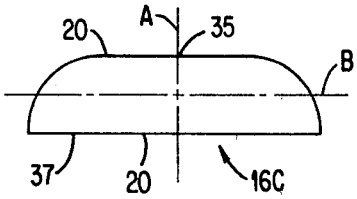
FIG. 6
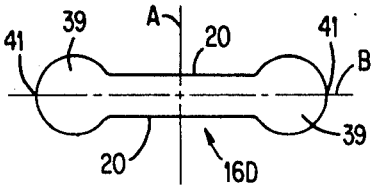
FIG. 7
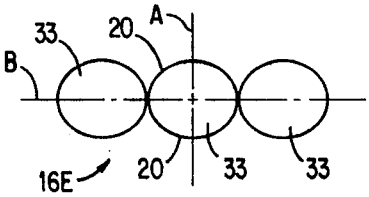
FIG. 8
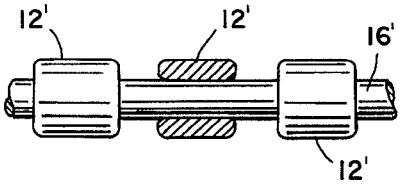

SPIRAL FABRIC PAPERMAKERS FELT FORMED FROM NON-CIRCULAR CROSS SECTION YARNS

CROSS REFERENCE TO RELATED APPLICATION

This application is a continuation-in-part of copending application Ser. No. 273,031, filed June 12, 1981, now U.S. Pat. No. 4,395,308.

BACKGROUND OF THE INVENTION

1. Field of the Invention

The present invention relates to a papermakers fabric, in general, and to a dryer felt constructed as a low permeability spiral coil fabric formed from non-circular cross section yarns.

2. Background of the Prior Art

A conventional dryer felt or fabric consists of an endless conveyor belt, typically made from a two, three or more plane fabric, wherein the various planes are defined by different groups of cross-machine direction yarns. The planes, plies, or layers, as they are variously called, are united by a plurality of machine direction yarns.

The yarns used to weave the most up-to-date dryer fabrics are generally made from synthetic monofilaments or synthetic multifilaments, from materials such as polyester, polyamide, acrylic and fiberglass. Dryer felts made predominately from monofilament yarns have certain drawbacks. Because the monofilament yarns are relatively stiff, they are not easily bent around each other during the weaving process. Thus, the fabric that results has a relatively open structure. There are several positions on the papermaking machine that do not run or cannot run effectively when employing a very open fabric because of numerous problems with the paper sheet, such as thread-up, blowing, flutter which causes sheet breaks, and reeling problems.

A number of attempts to reduce the openness or permeability of dryer fabrics made predominantly of monofilaments have been tried. The major approach has been to use a bulky yarn as a stuffer pick in the middle of the weave pattern. These stuffer picks are, in effect, surrounded by the original monofilament cross-machine direction picks that are positioned in both the face and back surfaces of the fabric. This approach has been successful in reducing permeability, but has added little or nothing to the stability of the fabric. It has also created the disadvantage that the spun stuffer pick is prone to collect dirt. Also, the stuffer picks have a tendency to retain and carry moisture, a condition which is usually undesirable.

A second approach has been to modify the woven structure in such a way that the top, or face, cross-machine direction picks are offset in relation to the bottom, or back, cross-machine direction picks. Although this approach has produced relatively low permeability in an all monofilament fabric, there is no easy way to change permeability. The weave design does not permit the use of stuffer picks. Changes in yarn diameter are, of course, possible, but such changes can only be made within the limitations of the loom.

Yet another example of a way to control permeability in a dryer felt is the incorporation of warp yarns of rectangular cross section into a weave pattern that does not include provision for stuffer picks. In such a weave pattern, the warp or weft yarn typically floats on the paper-receiving surface of the fabric over a number of weft picks or warp ends. The longer the float, i.e., the more picks the warp yarn crosses, or the more ends the weft yarn crosses, before weaving back into the fabric, the less stable the fabric becomes. In this way, there is a tradeoff between permeability and fabric stability.

In addition to woven fabrics, certain types of non-woven fabrics have been employed as dryer felts or fabrics. Of particular interest to the present invention are those made from cross-machine direction spiral coils that are intermeshed and joined together by cross machine direction hinge yarns to create the machine direction of a dryer fabric of desired length.

As is presently known, the predominant approach to reducing permeability in spiral fabrics involves filling the gap within a given spiral coil created when that spiral coil is secured by hinge yarns to two adjacent spiral coils. Typically the gap is filled with a stuffer-type yarn. Another approach uses smaller spirals in an attempt to reduce the size of the space within a given coil.

In the first approach, the stuffer yarns are usually inserted as an extra production step after the basic fabric has been manufactured and finished. Although permeability is reduced, fabric processing time is increased and, therefore, this approach is less economical. At the same time, the use of stuffer yarns tends to reduce the clean running of the fabric and also reduces its ease of cleaning as dirt will rapidly adhere to the stuffer yarn.

The use of smaller spirals, on the other hand, necessitates increasing the number of filling yarns (which act as hinge yarns) per unit length. This again reduces productivity and increases costs. In addition, it has been observed that the reduction in permeability is relatively small, such fabrics, at best, having 800 cfm or more.

There is thus a need for a dryer felt of spiral coil construction that may be easily and economically produced to provide a wide permeability range that is stable and also dirt resistant, and that exhibits reduced moisture carrying properties. The present invention is directed toward filling that need.

SUMMARY OF THE INVENTION

The present invention is directed primarily to a dryer felt although potential applications include forming wires, press fabrics and other industrial belting applications in the form of a spiral fabric that exhibits a marked reduction in permeabiity and flatter upper and lower surfaces. This is accomplished by using non-circular cross section monofilaments to form a plurality of individual spiral coils which are held together by hinge yarns which can be of circular or non-circular cross section. The typical permeability for known circular cross section spiral fabrics is about 800-plus cfm, at ½" water guage whereas for a dryer felt produced according to the teachings of the present invention, the permeability ranges from about 50 to about 500 cfm. The range is controlled by using differently dimensioned coil and hinge yarns.

The dryer felt of the present invention takes the form of a spiral fabric that consists of lengths of spiral monofilament or monofilament-like coils arranged so that they span in a cross-machine direction and lie in a common plane. An example of a monofilament-like coil is a coil made from a bundle of multifilaments or monofilaments that have been resin treated in a conventional manner so that the bundle acts as a monofilament.

In production, a first spiral coil is usually laid out to the required width of the fabric. A second spiral is then intermeshed (single coil to single coil) with the first spiral and a monofilament hinge yarn is inserted between the intermeshed coils to hold them together. In order to reduce torque in the fabric, the spiral lengths of the individual coils are alternately S-twist and Z-twist coils. The spiral coils are preferably formed from yarns having non-circular cross sections, which can be elliptical or rectangular.

The hinge yarns can also have a non-circular cross section and are sized and shaped relative to the spiral coils so that, when the hinge yarns join adjacent coils together, they do so in such a manner that they fill the opening defined when the coils are intermeshed.

After the hinge yarns are inserted, the resultant fabric is then subjected to heat treatment and controlled tensioning. Under those conditions, the various coils are flattened and lie against the sides of the hinge yarns. This structural arrangement creates a greater contact area between the fabric and paper sheet with an increase in drying efficiency resulting in higher productivity of the paper machine and reduced energy costs.

It is an object of the present invention to provide a dryer fabric of spiral construction having low permeability, good stability, good resistance to dirt, and which can be easily cleaned.

It is another object of the present invention to provide a dryer fabric made of monofilament or monofilament-like spiral coils, each of which is of non-circular cross section.

It is still another object of the present invention to provide a dryer fabric of spiral construction having flattened paper-receiving and machine-roll contacting surfaces for improved paper web support and for improved guiding.

It is a further object of the present invention to provide a dryer fabric having a reduced thickness to minimize stretching the paper sheet as the fabric passes around the machine rolls and to improve the heat transfer through the fabric by minimizing air pockets.

These and other objects will become apparent from the following drawings and detailed description.

BRIEF DESCRIPTION OF THE DRAWINGS

FIG. 1 is a top plan view of a portion of a spiral fabric embodying the subject invention.

FIG. 2 is a machine direction section of a portion of the spiral fabric of FIG. 1.

FIG 3 is a diagrammatic sketch of a yarn having an elliptical cross section.

FIG. 4 is a diagrammatic sketch of a yarn having a rectangular cross section.

FIG. 5 is a diagrammatic sketch of a yarn having a D-shaped cross section.

FIG. 6 is a diagrammatic sketch of a yarn having a dog bone shaped cross section.

FIG. 7 is a diagrammatic sketch of the cross section of a hinge yarn made up of three yarns placed side-by-side in a common plane.

FIG. 8 is a fragmentary cross sectional view showing a fabric having coils formed from monofilament yarns of generally rectangular cross section and taken along the line 8—8 of FIG. 1.

DETAILED DESCRIPTION OF THE DRAWINGS

With reference to FIGS. 1 and 2, a portion of a dryer fabric produced according to the teachings of the subject invention is shown and generally identified as 10. It is to be understood that the figures are in the nature of schematic representations and do not illustrate the elements of the fabric to any precise scale.

The dryer felt 10 basically comprises a plurality of spiral S-coils 12 joined together with a plurality of spiral Z-coils 14 through the use of hinge yarns 16 of non-circular cross section to create the fabric. The letters "S" and "Z" indicate the direction of twist of the spiral coils. A spiral coil has an S-twist if, when it is held vertically, the spirals or convolutions around its central axis slope in the same direction as the middle portion of the letter S, and Z-twist if the spirals slope in the same direction as the central portion of the letter Z.

With reference to FIGS. 1 and 2, the details of the fabric structure will now be described. The spiral coils 12 and 14 each consist of lengths of spiral monofilament, i.e., a monofilament with the appearance of a spring coil. The monofilament is synthetic in nature and is typically made from polyester, although other materials, such as, polyamide, polyolefin, polyetheretherketone and the like are contemplated.

In constructing a spiral fabric, a spiral coil (in this case S-coil 12) is first selected and laid out in what will eventually become the cross-machine direction, as indicated by arrow 11. Thus it can be appreciated that the width of the dryer fabric is thereby determined by the length of the coil. A second spiral (in this case Z-coil 14) is then intermeshed with the first spiral coil 12 to define a hinge yarn receiving opening 18. The opening 18 receives a hinge yarn 16 which is typically a synthetic monofilament, and like the spiral coils, may be of polyester polyamide, polyolefin, polyetheretherketone and the like. The insertion of the hinge yarns, which also span in the cross-machine direction, into adjacent intermeshed spiral coils acts as a pivotal hinge between the adjacent coils.

The laying down of additional spiral coils in an alternating 'S' coil and 'Z' coil relationship with the subsequent insertion of a hinge yarn is continued until a fabric of desired length is produced. The spiral coils are alternately S-twist and Z-twist coils so as to reduce torque in the fabric.

With reference to FIGS. 2 through 7 it can be seen that the hinge yarns 16 are of non-circular cross section. It is of particular importance that the yarns be of non-circular cross section because such yarns close the spaces or air voids between spiral coils to markedly reduce permeability, while at the same time increasing the contact area of the paper-receiving surface of the fabric.

FIG. 3 shows one embodiment for a non-circular hinge yarn. As can be seen, the cross section of the yarn 16A is approximately elliptical. As viewed in cross-section, the contemplated height of the yarn measured along the short axis A is within the range of about 0.1 to 2.0 mm., with the preferred range being from about 0.3 to 0.9 mm. The contemplated width of the yarn as measured along the long axis B is within the range of about 0.2 to 4.0 mm. with the preferred range being from about 0.33 to 2.25 mm. The ratio of the height-to-width of the yarn can be from 1:1.1 to 1:6, while the preferred range is 1:1.1 to 1:2.5. As used herein the long axis B is substantially parallel to the plane of the fabric and the short axis A is substantially perpendicular to the plane of the fabric.

FIG. 4 illustrates the cross section of yet another embodiment of the hinge yarn and bears the number 16B. As can be seen from the illustration, this yarn is generally rectangular in cross section with rounded corners 31. The height limitations, when measured along the axis A, and the width limitations, when measured along the axis B are similar to those of the elliptical yarn 16A. The ratio of height-to-width for yarn 16B also is similar to that of the elliptical yarn.

FIGS. 5 and 6 show two additional embodiments for the hinge yarns. Yarn 16C is a synthetic monofilament having a cross section resembling a "D" whereas yarn 16D is a synthetic monofilament having a cross section resembling a dog bone or dumbbell. The height and width dimensional limitations for yarns 16C and 16D are similar to those of the elliptical yarn 16A. In the case of yarn 16C, the height is measured along axis A at the thickest portion 35 of the "D" cross section whereas the width is measured along the base 37 (which is essentially parallel with axis B) of the "D". In the case of yarn 16D, the height is measured along the direction of short axis A and at the thickest portion of either of the two bulbous portions 39 of the dog bone cross section, whereas the width is measured along long axis B between the extreme ends 41 of the bulbous portion 39.

FIG. 7 shows yet another embodiment for the hinge yarn. In this case, the hinge yarn 16E is actually three synthetic monofilament yarns 33 of similar cross section positioned alongside each other to create an elongated configuration when viewed in cross section. The height and width limitations of this composite yarn 16E are similar to those of the elliptical yarn 16A. In the case of composite yarn 16E, the height is measured along axis A at the thickest portion of any of the similar yarns 33, whereas the width is measured along axis B between the extreme ends of the outermost yarns 33, with all three yarns lying in a plane essentially parallel to axis B.

Thus it will be appreciated that the hinge yarns may take on essentially any configuration that has a long and short axis cross section. As already pointed out, this includes rectangular, elliptical, D-shaped, dog bone and even two or more circular or non-circular yarns of the same or different cross sections inserted simultaneously side-by-side. The choice of cross section is affected by the flexibility required in the finished fabric, rectangular and elliptical yarns giving less flexibility than dog bone and side-by-side yarns.

The overall size and shape of the hinge yarn depends on the size and shape of the spiral coils and the yarn-receiving openings that the coils define when they are intermeshed.

After the dryer fabric has been formed through the intermeshing of the S-twist and Z-twist coils and the insertion of the hinge yarns, the fabric is then subjected to heat treatment and controlled tensioning. The tension control is placed in what will become the machine direction. Under these circumstances, the spiral coils 12, 14 which were originally circular or elliptical in transverse section now flatten to press up against the long sides 20 of the hinge yarns. At the same time, the controlled tensioning and resultant flattening of the spiral coils causes necessary crimping to occur in the hinge yarns. The crimp resulting from the heat treatment is desirable to stabilize the fabric and to ensure good runnability on the paper machine, i.e., no distortion or stretching. The crimping also ensures that the hinge yarns do not move laterally so as to leave an opening on either edge of the fabric. Thus, upon completion of the heating and controlled tensioning operations, a fabric is created in which the hinge yarns all lie in a common plane. In like manner, the spiral coils are flattened and also lie in the same common plane of the fabric.

Because of the non-circular cross-sectional shape of the hinge yarns, it is possible to control the flatness of the paper-receiving and machine roll contacting surfaces of the dryer fabric. By the appropriate use of temperature, time and tension, the spiral may be flattened out so that it can be pulled down flat against the flat section or long sides of the hinge yarn. The flatter the surfaces of the dryer fabric, the greater is the contact area between the fabric and the paper sheet, as well as the contact area between the hot cylinder surface and the same paper sheet. This increases drying efficiency and results in higher productivity of the paper machine thereby reducing energy costs. In addition, by increasing the contact area, the air void areas 22 (FIG. 2) are reduced and, therefore, there is less chance of the fabric marking the paper sheet, particularly on critical paper grades.

Increasing the mass of the monofilament hinge yarn 16 in a given area within the fabric causes a reduction in air voids. In this way, the fabric maintains a higher operating temperature so that dryer efficiency is enhanced. Additionally, the dimensional stability of the dryer fabric is increased by the use of the large hinge yarns 16, because there is less 'void' area available for the coils to move into.

The improved fabric flatness on the surfaces of the fabric improves calendering effects by imparting increased smoothness to the paper sheet. Also, the increased flat contact area decreases the picking effect of the fabric on the paper sheet on after-size and after-coating positions, since there are no weave imperfections that size or coating can adhere to.

It has been found that the desirable flatter upper and lower surfaces of the fabric can be obtained by using coils formed from yarns having non-circular cross sections, and particularly yarns having generally rectangular cross sections. Specifically, when coils formed from generally rectangular cross sections are employed, the flatter, and therefore greater, surface area of the resulting fabric provides increased contact area with the paper web, for increased web support, and it also provides increased contact area with the respective guide rolls which are commonly found in papermaking machines and about which the fabric passes. By virtue of the increased guide roll contact, the guiding of the fabric around the several rolls is substantially improved, and it also has been found that the resistance to surface abrasion of the resulting fabric is also improved by virtue of the greater contact area.

Moreover, because the fabric is thinner, the unit mass of yarns is greater and therefore the amount of air acting as insulation is diminished. This permits the fabric to run hotter which, with increased contact area increases the drying efficiency on the paper sheet. Additionally, by providing coils formed from yarns having rectangular or other non-circular cross sections, the thickness of the resulting fabric is reduced, thereby increasing its flexibility and minimizing the presence of moisture laden air therewithin, which avoids rewetting of the paper sheet. Thinner fabrics also involve less machine direction stretching of the paper sheet as it is carried around the various rolls on the outside surface of the fabric. Additionally, the reduced air space within the fabric allows the use of a wider range of stuffer picks without the danger of the fabric running wet. For example, monofilament, continuous filament slit or split film, tape, and spun yarns can be utilized to form the hinge yarns. Additionally, by the use of different types of hinge yarns, fabrics having controlled variations in permeability across the fabric width can be produced.

Structurally the preferred coils having the attributes described above can be formed from monofilaments as illustrated in cross section in FIGS. 3 and 4. The longer sides 20 are substantially flat and parallel and are so oriented that they lie generally parallel with the upper and lower surfaces of the resulting fabric. The spacing between the respective surfaces 20 defines the thickness of the coil yarn and the distance between the respective end portions 20*a* defines the width of the coil yarn. The width to thickness ratio of the coil yarns can range from about 1:1.1 to about 1:6, and preferably lies within the range from about 1:1.5 to about 1:2.0.

FIG. 8 is a fragmentary cross sectional view of a fabric formed from spiral coils wherein the coils are of monofilament having a generally rectangular cross section. As shown, hinge yarn 16' passes between interengaging coils 12', the coil yarns having their major axes generally parallel to the upper and lower surfaces of the fabric to provide the benefits of the present invention.

In the course of the formation of the fabric as hereinabove described, it is intended that the respective coil yarns and hinge yarns are substantially non-deformed, so that their respective cross sections remain constant throughout their respective lengths, and so that they are substantially free of surface discontinuities. Although it is virtually impossible to completely eliminate surface deformation at points of contact between the coil yarns and the hinge yarns, particularly when flexible synthetic monofilaments are employed, the improved fabric of the present invention does not require that there be such deformation to provide a coherent fabric, as has been suggested in the prior art. Thus, reference to the substantially uniform cross sections of the yarns in the present invention and that such yarns are substantially free of surface discontinuities is intended to reflect the fact that such non-uniformities and discontinuities are not intended, although they may be present to a very slight degree, and are not necessary for the proper functioning of the present invention.

The spiral coils of non-circular cross section yarns provide a further advantage over such coils formed from yarns having a circular cross section in that the corners that result when coils formed from the latter are flattened are prone to fibrillate, or split into fibrils across the thickness of the monofilament at the points of greatest stress, whereas the former are less prone to such fibrillation. The fibrillation is a particular problem with the circular cross section yarns when incorrect heat treating conditions are employed to heat stabilize the spiral fabric. Such incorrectly heat stabilized fabrics can fail quickly on the papermaking machine, even though there is no outwardly visible sign of fibrillation in the finished fabric. However, the use of non-circular cross section yarns to form such spiral coils has been found to reduce substantially the tendency to fibrillate.

Although the present invention has been shown and described in terms of specific preferred embodiments, it will be appreciated by those skilled in the art that changes or modifications are possible which do not depart from the inventive concepts described and taught herein.

Further, it is contemplated that the coil yarns need not be monofilament, the only requirement being that the coil yarns behave like monofilaments. An example of a yarn that behaves like a monofilament is one made from a bundle of synthetic multifilaments or monofilaments, such as polyester, that have been resin treated in a conventional manner so that the bundle acts as a monofilament. Typically the resin is applied by moving the bundle and resin through a sizing die. In this way a cross section of desired configuration can be made. Such changes and modifications are deemed to fall within the purview of these inventive concepts.

What is claimed is:

1. A papermakers fabric having an upper surface and a lower surface, said fabric comprising:

a plurality of hinge yarns, all of said hinge yarns extending in a common direction;

a plurality of spiral coils disposed in a common plane in a side-by-side relationship, each of said coils extending in said common direction, adjacent coils of said spirals intermeshed and held together in intermeshing relationship by at least one of said hinge yarns, said spiral coils formed from yarns having a non-circular cross-section;

each of said hinge yarns and each of said coil yarns having uniform cross sections throughout their respective lengths and being substantially free of surface discontinuities.

2. The papermakers fabric of claim 1 wherein at least one of said coil yarns and said hinge yarns is a synthetic monofilament.

3. The papermakers fabric of claim 2 wherein said synthetic material is chosen from the group consisting of polyester, polyamide, polyolefin and polyetheretherketone.

4. The papermakers fabric of claim 1, wherein said hinge yarns are of non-circular cross section selected from the group consisting of a rectangular cross section, an elliptical cross section, a D-shaped cross section, and a dog bone shaped cross section.

5. The papermakers fabric of claim 4, wherein each of said non-circular cross sections has a long axis and a short axis, said long axes of said hinge yarns being aligned substantially parallel to the plane of the fabric, and said short axes of said hinge yarns being substantially perpendicular to the plane of the fabric.

6. The papermakers fabric of claim 5, wherein said short and long axes of each hinge yarn are in the ratio of about 1:1.1 to about 1:6.

7. The papermakers fabric of claim 6, wherein said ratio is in the range of about 1:1.1 to about 1:2.5.

8. The papermakers fabric of claim 1 wherein the width to thickness ratio of said yarns ranges from about 1:1.1 to about 1:6.

9. The papermakers fabric of claim 8 wherein the width to thickness ratio of said yarns ranges from about 1:1.5 to about 1:2.0.

10. The papermakers fabric of claim 1 wherein each of said coils is formed from a yarn having two pairs of opposed, substantially flat surfaces one pair of said surfaces having a length greater than that of said other pair of surfaces when viewed in cross section, the longer of said surfaces lying in planes substantially parallel to said upper and lower surfaces of said fabric.

11. The papermakers fabric of claim 10 wherein said opposed surfaces are substantially parallel.

12. The papermakers fabric of claim 1 wherein each of said coils is formed from a non-circular yarn having a long axis and a short axis, said long axes of said coil yarns oriented substantially parallel to the upper and lower surfaces of said fabric and said short axes of said coil yarns oriented substantially perpendicular to said surfaces.

13. The papermakers fabric of claim 12 wherein said coil yarns are of generally elliptical cross section.

14. The dryer fabric of claim 1 wherein said spiral coils are formed from yarns that act like a monofilament.

* * * * *